US006883450B2

(12) United States Patent
Kingsbury

(10) Patent No.: US 6,883,450 B2
(45) Date of Patent: Apr. 26, 2005

(54) BOAT HULL DESIGN

(76) Inventor: Robert P. Kingsbury, P.O. Box 1099, Laconia, NH (US) 03247

( * ) Notice: Subject to any disclaimer, the term of this patent is extended or adjusted under 35 U.S.C. 154(b) by 0 days.

(21) Appl. No.: 10/613,543

(22) Filed: Jul. 3, 2003

(65) Prior Publication Data

US 2005/0000400 A1 Jan. 6, 2005

(51) Int. Cl.[7] ..... B63B 1/00
(52) U.S. Cl. ..... 114/61.1; 114/61.2
(58) Field of Search ..... 114/61.1, 61.2, 114/56.1, 355; 440/38

(56) References Cited

U.S. PATENT DOCUMENTS

| | | | | |
|---|---|---|---|---|
| 2,440,345 A | * | 4/1948 | Neel | 114/61.1 |
| 3,782,114 A | * | 1/1974 | Broes | 440/38 |
| 3,786,772 A | * | 1/1974 | Broes | 114/61.1 |
| 3,908,573 A | * | 9/1975 | Broes | 114/61.1 |
| 4,069,782 A | * | 1/1978 | Broes | 114/61.2 |
| 5,549,066 A | | 8/1996 | Kingsbury | |

OTHER PUBLICATIONS

M.D. Van Orden and R.D. Gaul, "Variable Draft Broadens SWATH Horizons", *Proceedings*, Apr. 1994,109-111 U.S.A.
S.F. Brown, "The Secret Ship", *Popular Science*, Oct. 1993, pp. 94-96, U.S.A.
S.F. brown, "World's Fastest Sailboat", *Popular Science*, Jan. 1991, pp56-61, U.S.A.
R. Akers, "Wave Piercers and Fast Cats", *Professional Boatbuilder*, Dec./Jan. 2002, pp 54-67, U.S.A.
G.R. Worthington, "Littoral Warfare Needs A Specific Ship", *Proceedings*, Jan. 2003, pp. 90-91, U.S.A.

* cited by examiner

*Primary Examiner*—Lars A. Olson
(74) *Attorney, Agent, or Firm*—William B. Ritchie

(57) ABSTRACT

A multi-hull design suitable for various size boats ranging from racing craft to the large military ships. The apparatus is a polygonal boat hull apparatus having a bow and stern wave penetrating feature. The hull is made from triangular-shaped essentially flat panels which provides for substantially stability and strength. The hull can be made in various configurations ranging from catamarans, triamarans to multiple hull designs in accordance with the projected use of the vessel. The invention includes a drive pod system having a plurality of propulsion units. The invention also provides at least one hydropneumatic cylinder that adjusts the angle of attack of the propulsion unit. The hull may also be rigged as a multi-masted sailing vessel.

10 Claims, 9 Drawing Sheets

Stern View

Bottom Perspective View

BOAT HULL DESIGN

FIELD OF THE INVENTION

The present invention relates to the field of boat hull designs, in particular, multi-hull designs.

BACKGROUND OF THE INVENTION

It is well known in the industry that watercraft with a multi-hull design provide better seakeeping in moderate-to-high wave conditions than monohull vessels. Multi-hull ships can be designed to experience only one-half to one-fifth of the heave, pitch, and roll motions of a monohull vessel of equal displacement in seas driven by wind speeds above 20 knots.

An additional benefit of multi-hull designs is they can travel at faster speeds than a monohull design. The wave penetrating features of a multi-hull design allow the watercraft to also maintain course and speed during sea conditions that would otherwise defeat a monohull's ability to maintain the same course and speed.

However, an inherent problem with multi-hull designs is, in the event of a roll-over, they do not return upright once capsized. A multi-hull vessel is equally stable capsized as it is upright. Monohull vessels do not have this problem.

Through innovative designs and concepts, various hull designs have been introduced. In an article titled "Variable Draft Broadens SWATH Horizons" in the April 1994 issue of Proceedings, improvements are made to the design known as Small Waterplane Area Twin-Hull (SWATH) ships. The SWATH design for this particular boat utilizes struts that are aligned on the centerline of the lower hull. The lower hull's rectangular cross sections enhance seakeeping at deeper drafts and give best propulsion at transit depths. The center bow provides a cushion against slamming and affords convenient overboard access for handling equipment. Rectangular hull forms supportive of the SWATH design are less expensive to fabricate and outfit than conventional hull designs.

The U.S. Navy test vessel, Sea Shadow, was built to test several aspects of maintaining stealthiness at sea, including low radar visibility, quietness to sonar sensors and minimizing wake. An article titled "The Secret Ship" in the October 1993 issue of Popular Science discussed the unclassified parameters of this vessel. Above the waterline, the Sea Shadow's resemblance is similar to that of the U.S. Air Force F-117A stealth fighter. From the waterline down, the exact details are classified, but the ship's underwater shape is essentially a SWATH design. A pair of submerged pontoons gives the Sea Shadow its buoyancy. Running beneath the water's choppy surface layer, these pontoons cause far less of the seasickness-inspiring vertical motion inherent in traditional monohull designs.

Another unique design is the trimaran hydrofoil designed and built by Greg Ketterman, as discussed in an article titled, "World's Fastest Sailboat," in the January 1991 issue of Popular Science. The hydrofoil is a two-mast, triple-hull design that utilizes sensors forward of the outer hulls that hug the water's undulating surface, constantly adjusting the pitch of the hulls and main foils to maintain stability and minimize drag. Foot pedals control the rudder. This design is primarily for sail boats that want to maximize speed through the waters. However, this design is not suitable for large boats, and lacks a propulsion system often desired in larger boats.

U.S. Pat. No. 5,549,066 issued on Aug. 27, 1996 to the present inventor, discloses a multi-hull triangular design constructed from flat pieces of material instead of curved sections normally used for boat hull construction. The patent also teaches the use of a bilateral fore and aft symmetrical boat hull. Although this design is suited for rowboat sized boats and pleasure boats, the design is also inherently suited for larger boats such as destroyers.

Ocean Waves, even in relatively calm seas, have amplitudes and lateral modulations. In stormy seas, those amplitudes and modulations often tear multi-hull ships apart. The current propulsion systems for large multi-hull ships lack a mechanism to cope with the up and down movement of the waves, and also lack structure to protect the multi-hull ship from being ripped apart.

Recently, wave piercing designs have been developed which have shown great promise. As disclosed in an article entitled, "Wave Piercers and Fast Cats", written by Richard Akers and published in December/January, 2002 issue of *Professional Boatbuilder*, multiple narrow hulls enable the use of substantially less horsepower to propel the craft than a vessel having similar displacement but with wider multiple hulls or a monohull.

The U.S. Navy, among others, is also interested in having speed vessels some of which have flat decks for use as equipment carrying ships. The desire for higher speed ships as well as being more difficult to see on radar is near the top of the Navy's wish list. As example, discussed in the U.S Navy Proceedings, January, 2003, the need for a combat littoral ship which is lethal, agile, survivable and versatile is critical if the U.S. is to maintain naval supremacy. However, a catamaran hull design is limited but it lacks the stealth capability and is not self-righting if rolled over.

All of the above are particularly important when attempting to design racing boats. The typical high speed racing hydroplanes are known to have problems of having the bow lifting up due to relative small action which cause the hull to porpoise. The bow lifting causes the stern to dig in further, the engines keep driving the craft forwarded, and, finally, the boat can airborne, eventually flipping over on its back. Such crashes frequently cause operators severe injuries and even can be fatal.

Therefore, a multi-hull design for a large boat that protects the ship from being ripped apart by the changing amplitudes and modulations of the ocean, and a propulsion system that provides a means for optimizing the ship's speed through varying sea conditions ship is desired in the art.

SUMMARY OF THE INVENTION

The present invention relates to a boat design that is multi-hull, with each hull having a bow and stern sections that are essentially symmetrical and have wave penetrating features. The bow and stern sections are formed from more than three, preferably five triangular surfaces meeting at meet at common point. The polygonal features of the hull design run both athwartships and from stem to stem. The invention also features a plurality of drive pods which are attached to the hull of the apparatus and facilitate adjustability for varying ocean conditions. The multiple drive pods under the hull provide a drive system that appears centipede-like.

Therefore, it is an aspect of the present invention to provide a polygonal boat hull apparatus that is economical to build, suitable for large ocean vessels as well as smaller racing craft, and even sail powered yachts.

It is another aspect of the invention to provide a polygonal boat hull apparatus suitable for large sea vessels that has dual ended fore and aft wave penetrating features in order to provide added strength compared to other types of wave penetrating hull designs.

It is another aspect of the invention to provide a triangular boat hull apparatus that is both air and water tight, so that in the event of a roll-over, no water would enter.

It is another aspect of the invention to provide a boat hull apparatus where the inherent internal triangular design of the hulls prevents the multi-hull boat from being torn apart in inclement weather.

It is another aspect of the invention to provide a boat hull design that has dual ended fore and aft wave-penetrating features in order to provide greater stability, particularly when the wave motion is severe.

It is another aspect of the invention to provide a drive pod that is capable of incorporating diesel, electric, or water jet propulsion engines.

It is another aspect of the invention to provide a drive pod that incorporates either a single or dual propeller.

It is another aspect of the invention to provide a drive pod with a hydropneumatic cylinder that absorbs the pounding from wave action and can be adjusted to meet operating conditions on the ocean.

It is another aspect of the invention to provide a propulsion system for a multi-hull apparatus where multiple drive pods are attached under the hull of the apparatus.

It is a further aspect of the invention to provide a propulsion system for a multi-hull apparatus that can be easily modified to be suitable to any sized multi-hull vessel ranging from a small racing craft, sailing yacht to the largest military ships such as destroyers.

It is a further aspect of the invention to provide a propulsion system for a multi-hull vessels that provide the strength needed to resist the lateral modulations of ocean waves.

It is a final aspect of the invention to provide a propulsion system that can be adjusted to meet a variety of operating conditions.

These aspects of the invention are not meant to be exclusive and other features, aspects, and advantages of the present invention will be readily apparent to those of ordinary skill in the art when read in conjunction with the following description, appended claims and accompanying drawings.

DETAILED DESCRIPTION OF THE INVENTION

Figure 1:
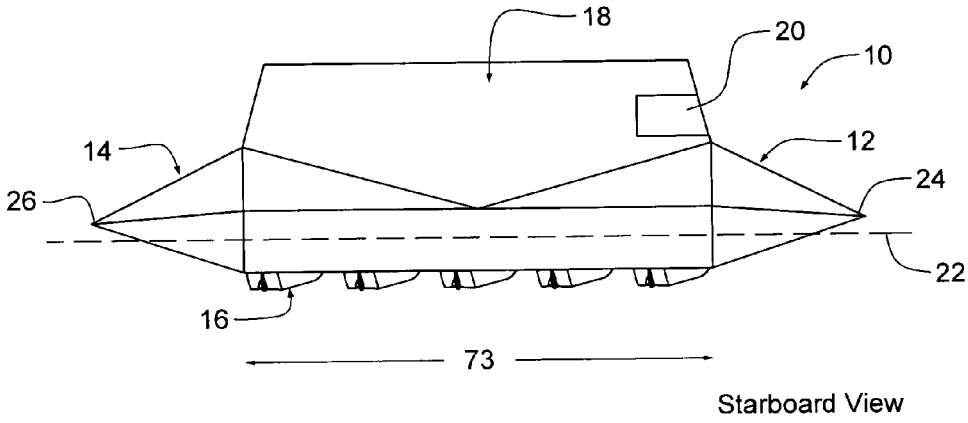
FIG. 1 is a starboard side view of the multi-hull apparatus in accordance with the invention.
Figure 2:
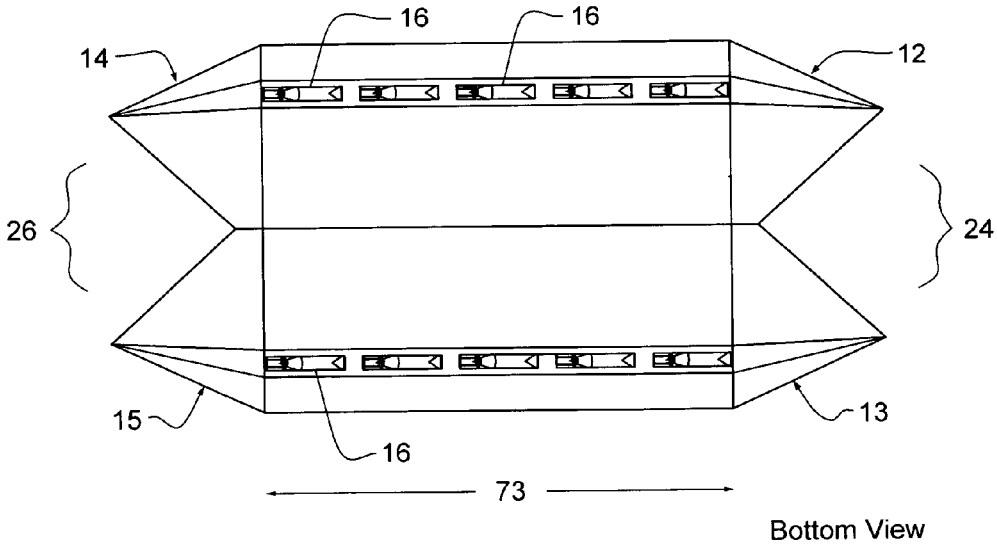
FIG. 2 is a bottom view of the apparatus.

Referring to FIGS. 1–5, the catamaran embodiment of the multi-hull apparatus 10 is shown. Bow 24 and stern 26 are typically above water line 22 in a calm seaway so bow 24 can function as a wave penetrating design. The apparatus 10 is made up of a port (left) hull 13, 15 and a starboard (right) hull 12, 14. As depicted in FIG. 1, the port hull sections 13, 15 and starboard hull 12, 14 are of equal dimensions and are each connected to one another. As shown, top section 18 is depicted for illustration purposes only. The top 18 is not necessarily triangular but could be flat or have the top portion of any ship design commonly known to those skilled in the art.

The multi-hull apparatus 10 is constructed entirely from flat pieces of material instead of curved sections normally used for hull construction. Apparatus 10 can be sized for a variety of watercraft ranging from hi-speed racers, multi-masted sailing vessels to even the largest military ships. The apparatus 10 design will inherently displace a large amount of water thus can be used for larger ships carrying larger loads. Examples of these types of watercraft are destroyers or cargo ships. Building watercraft of various sizes will require scaling the dimensions accordingly using techniques well known in the art. The preferable material selected for construction is molded fiberglass for smaller size craft. Steel and other types of material typically used in the boat construction industry, including exotic materials offering protection against radar detection could also be used. The hull could even be fabricated from new composites not currently known.

As will be noted, the invention is intended for any number of hull multi-hull watercraft. Thus, depending on the size of the watercraft in which the multi-hull apparatus 10 is intended, the number of hulls will increase accordingly. The minimum catamaran hull multi-hull apparatus is illustrated. However, increasing the number of hulls can easily be designed by a person of ordinary skill in the art by simply continuing the pattern evenly on both sides of the multi-hull apparatus 10 as shown.

The wave penetrating aspects of the hull will be discussed first. Since the hull is essentially bilaterally symmetrical, both from an athwartships perspective as well as from bow to stern view, the bow sections are preferably substantially identical to the stern sections, excepting the drive pod orientation and pilot house 20.

Figure 3:
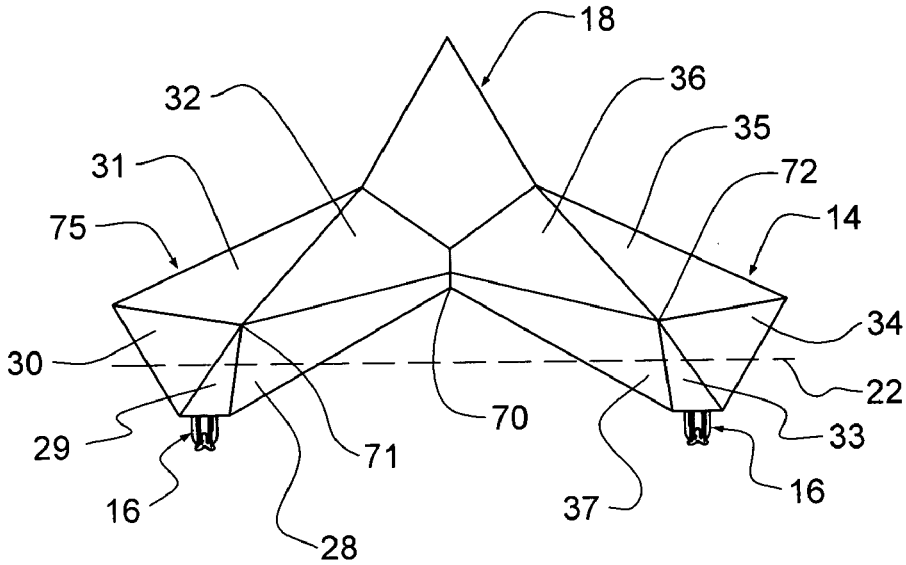
FIG. 3 is a stern view.
Figure 4:
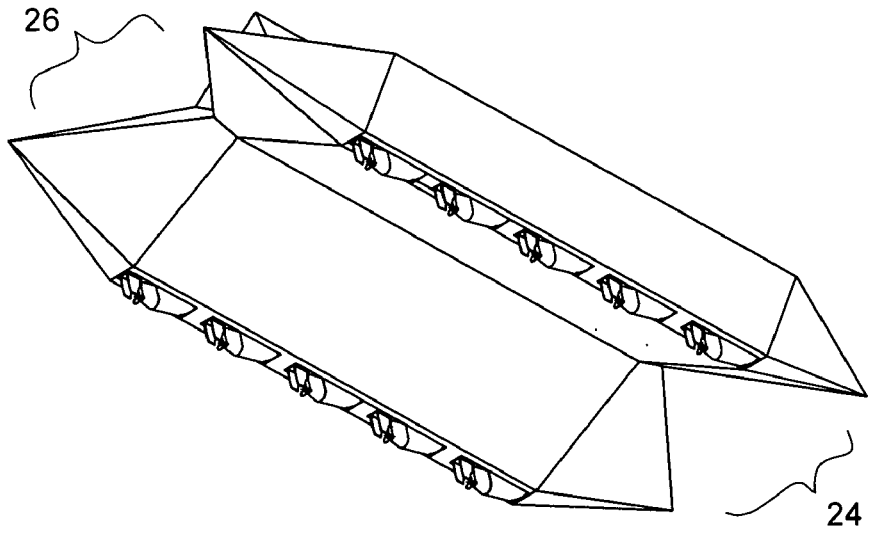
FIG. 4 is a bottom perspective view showing the drive pod system.

Each wave penetrating section is made up five panels as shown in FIG. 3. The port (left) hull section 15 is made up of panels 28, 29, 30, 31 and 32 meeting at apex 71. Similarly, starboard (right) hull section 14 is made up of panels 37, 36, 35, 34 and 33 meet at apex 72. The respective port and starboard stern hull sections meet at the centerline 70 of the hull. Similarly, bow sections 12 and 13 are constructed the same. A plurality of drive pods 16 is affixed to the flat continuation of starboard panel 33 and port panel 29.

As noted above, vertexes 71 and 72 will be above water 22 when the watercraft is at sea under most conditions, except when the watercraft experiences substantially waves heights.

The fore and aft polygonal shapes used to provide the wave penetrating sections improve the strength of multi-hull apparatus 10 in both compression and tension so that heavy sea conditions will not buckle and pull apart multi-hull apparatus 10. The dimensions and angles provided for the athwartships hull sections 73 and 74 can vary to correspond with other dimensions selected for the desired size of triangular boat hull apparatus 10 to be built. Accordingly, the corresponding wave penetrating sections will be scaled appropriately using techniques well known in the ship building arts.

Figure 5:
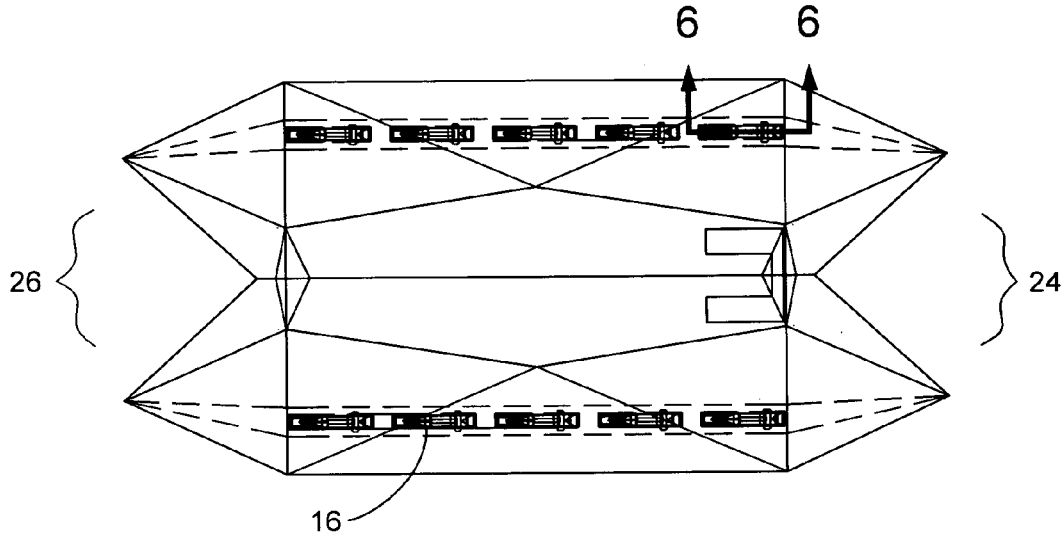
FIG. 5 is a top view.
Figure 6:
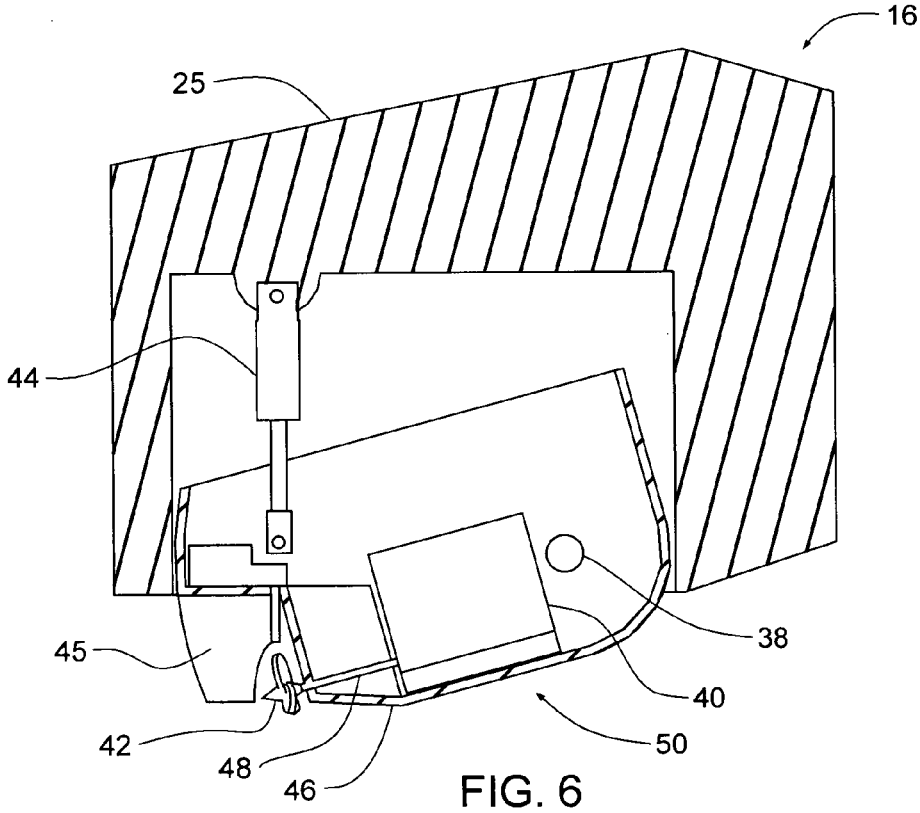
FIG. 6 is detailed sectional view of a single drive pod along line 6—6 shown in FIG. 5.

Referring next to FIGS. 5 and 6, the drive pod system 16 is shown in detail. In the preferred embodiment, each drive propulsion unit 50 has a housing 46 which is attached to portion 25 of the hull as discussed above. Each housing 46 has a propeller 42 extended therethrough and connected to an engine 40 via a shaft 48. Rudder 45 is shown aft of the propeller. If multiple rudders 45 are utilized, then they must be synchronized, using techniques well known in the art, to turn the craft smoothly and efficiently.

Engine 40 could be either gas, diesel, electric or an alternative fuel such as hydrogen. Each propulsion unit 50 is pivotally connected to the hull via pivot point 38 and hydraulic assembly 44 so that the housing 46 can be retracted within the hull. The housing can also be lowered and raised to adjust trim of the hull for cavitation, wave penetration or other considerations in the same manner as provided in pleasure craft stern drive propulsion systems.

The propeller 42 is shown in its preferred embodiment to be a five bladed propeller, made of steel. However, the propeller could be made of aluminum or any other non-corroding material that is typically used for marine propellers. In other embodiments, the propeller 42 is a three bladed propeller, or, in place of a single propeller, there are multiple propellers.

Figure 7:
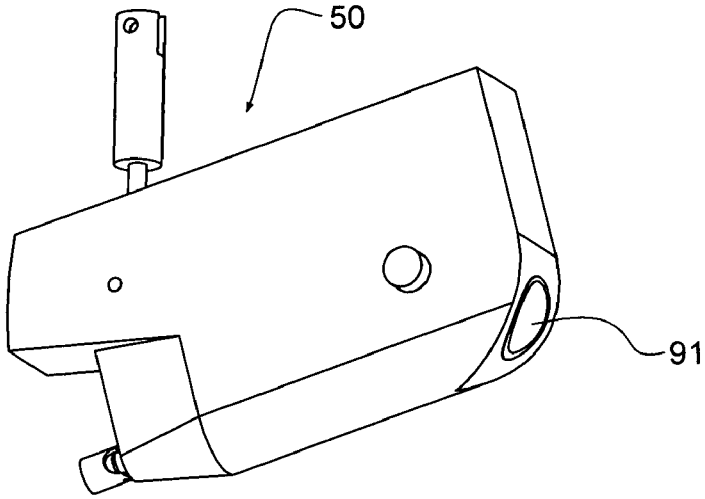
FIG. 7 is a detailed perspective view of a drive propulsion unit using an impeller water jet.
Figure 8:
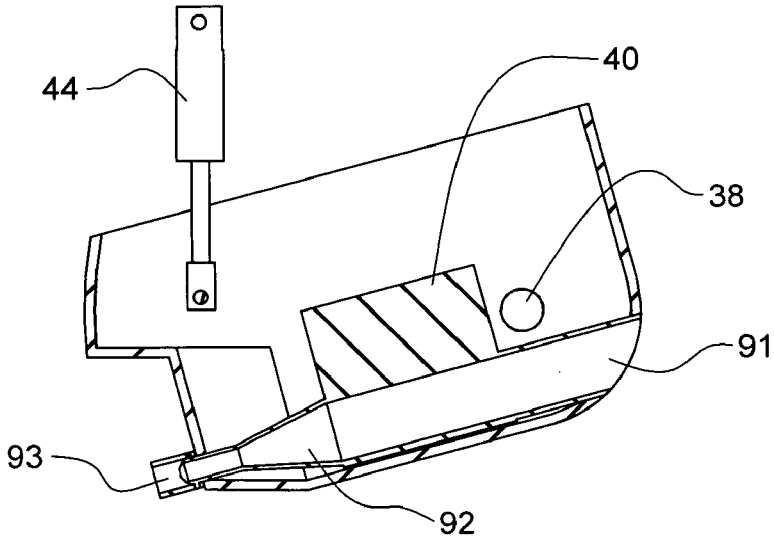
FIG. 8 is a detailed cross sectional view of the drive propulsion unit shown in FIG. 7.

As shown in FIGS. 7 and 8, a water jet drive using an impeller is also suitable as propulsion units 50 to make up drive pod system 16. The jet drive propulsion unit is basically the same as one using a propeller. However, the use of rudder 45 is no longer necessary as this type of unit is steered by directing the flow of the jet. Water is brought into impeller 92 via intake 91 and exits via jet 93. The craft is steered by directing the jet either to the left or right of the current direction of travel to cause the turning to take place.

Figure 9:
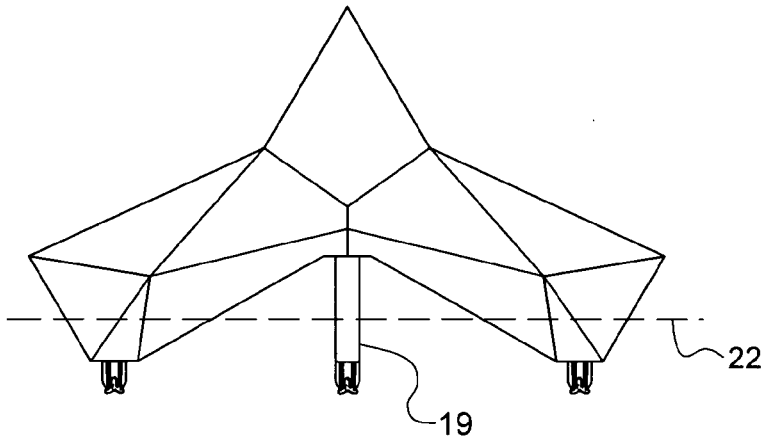
FIG. 9 is a stern view of an alternative embodiment of the drive pod system.
Figure 10:
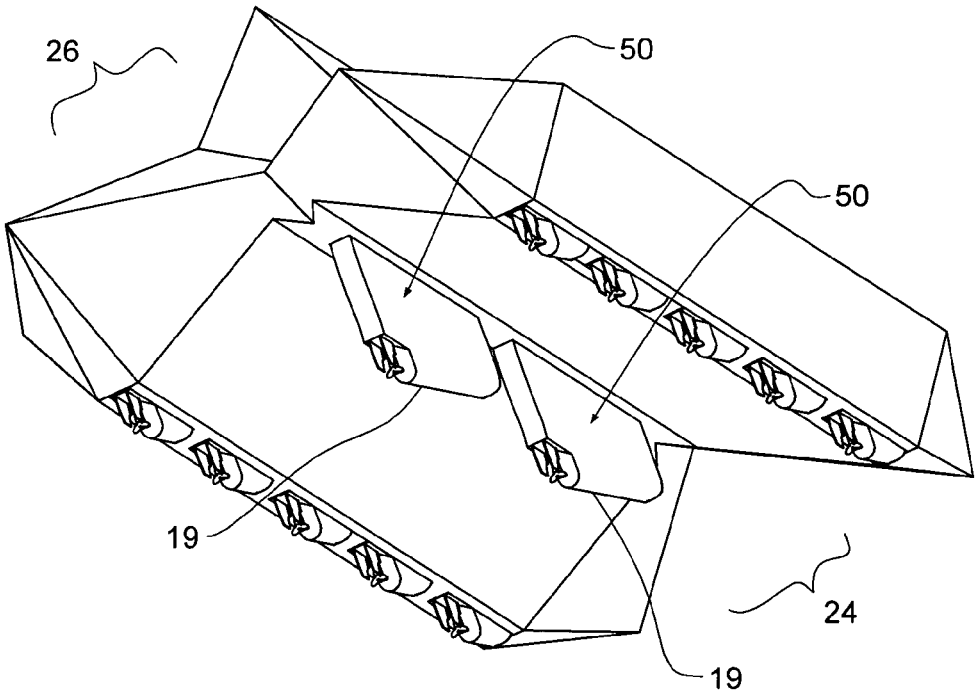
FIG. 10 is a bottom perspective view of the alternative embodiment drive pod system shown in FIG. 9.

FIGS. 9 and 10 is a stem view of an alternative embodiment of the drive pod system. In this embodiment, centerline drive pod system 19 is added. In this example, only two propulsion units 50 are provided, however, large vessels may have three or more such units.

Figure 11:
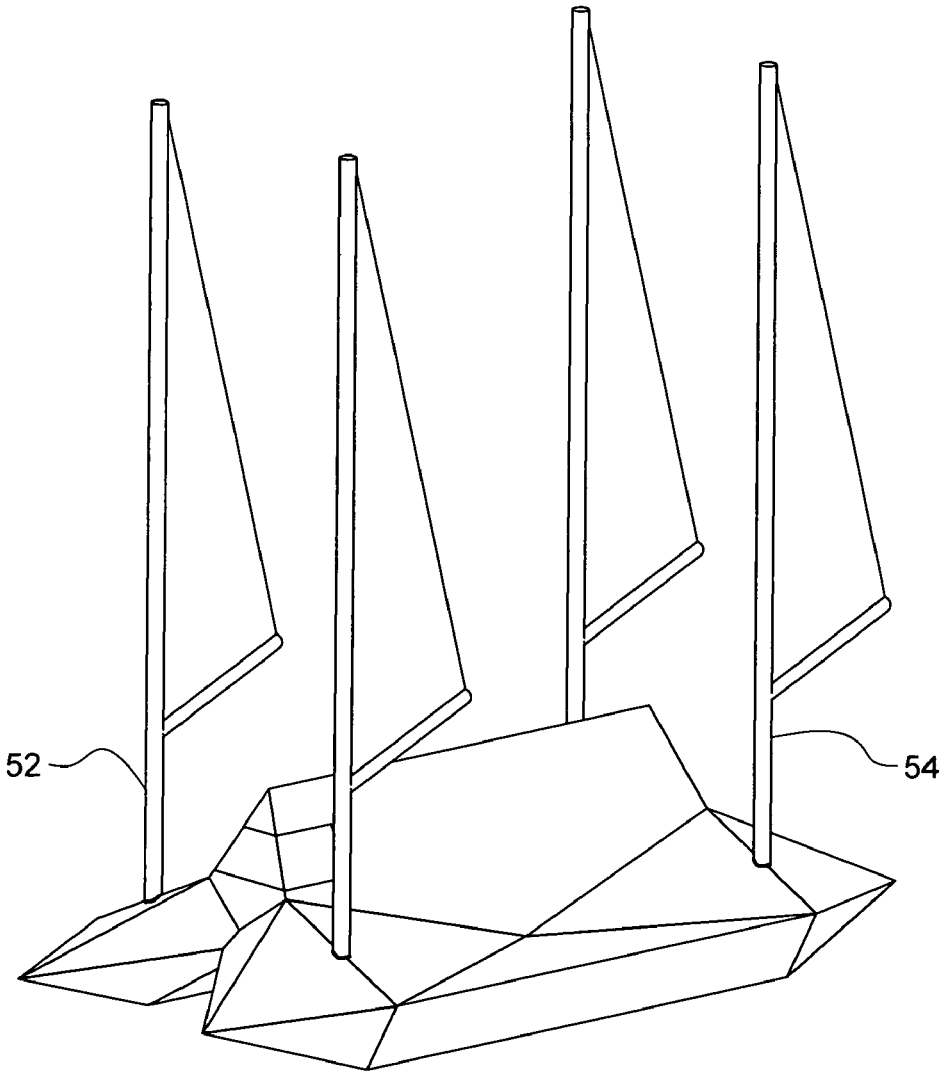
FIG. 11 is an alternative embodiment of the multi-hull apparatus rigged as a sailing vessel.

FIG. 11 is an alternative embodiment of the multi-hull apparatus rigged as a sailing vessel. In this example, which is outfitted to a catamaran version of the invention, only four masts of the same height are used. Further, the use of a cloth sails is shown. However, rigid airfoils as well as various rigging designs such as ketch, yawl and schooner could be adapted to the invention using techniques well known in the art. Each hull section in this embodiment or any others could be configured with sufficient ballast below the centerline of said apparatus such that if said apparatus is turned bottom-side up, said apparatus will return to bottom-side down by itself.

Figure 12:
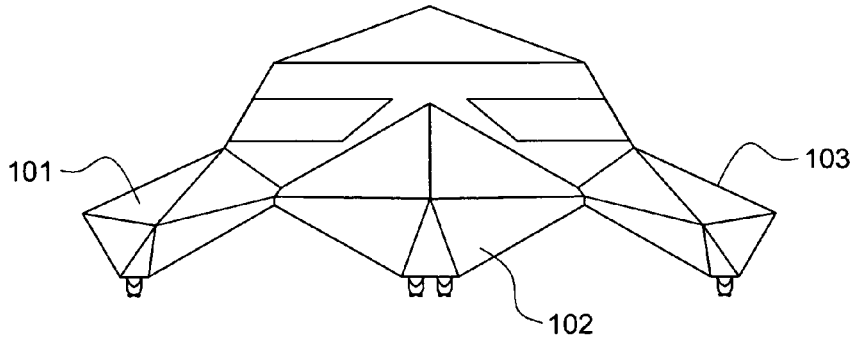
FIG. 12 is bow view of the multi-hull apparatus configured as a trimaran.
Figure 13:
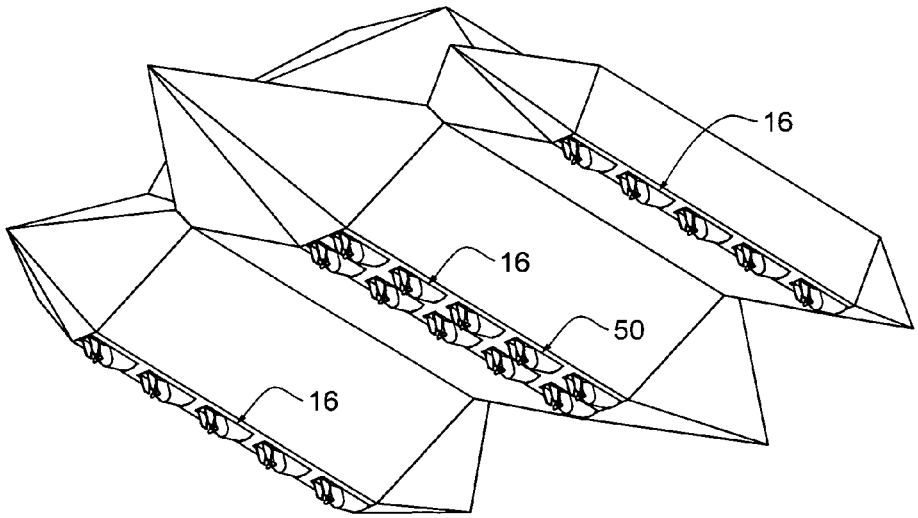
FIG. 13 is bottom perspective view of the trimaran shown in FIG. 12 showing the drive pod configuration.

FIG. 12 is bow view of the multi-hull apparatus configured as a trimaran. Note that each wave penetrating section 101, 102 and 103 is preferably manufactured from five panels which meet at point just as found in the catamaran version. As shown in FIG. 13, the drive pod system 16 uses four rows of propulsion units 50. However, the center rows of drive pod system 16 could be eliminated or made as a single row depending on the mission requirements for the vessel.

Figure 14:
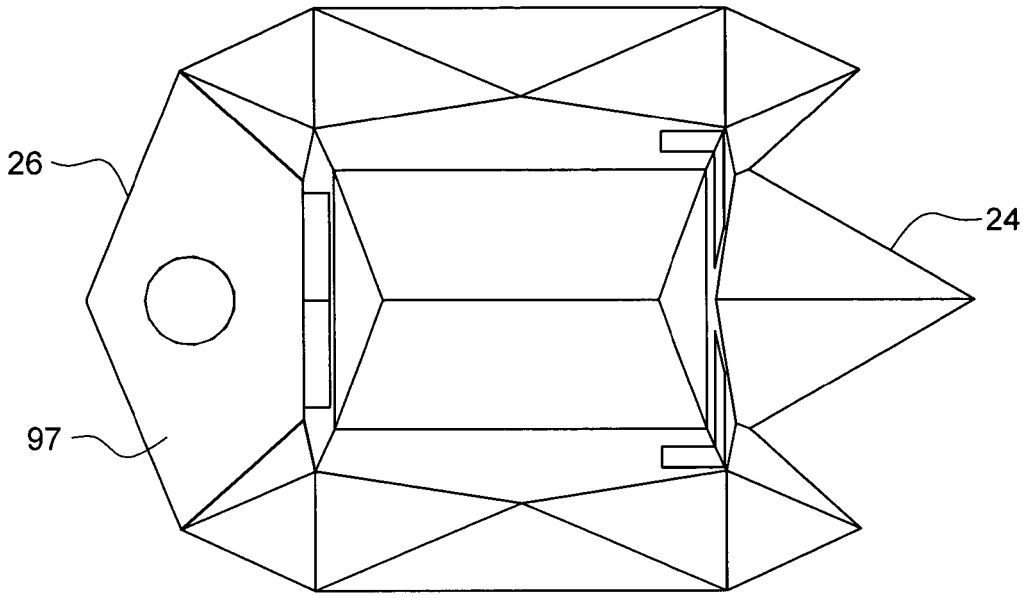
FIG. 14 is a top view of the trimaran shown in FIG. 12 configured with a helicopter pad and hanger in the stern.
Figure 15:
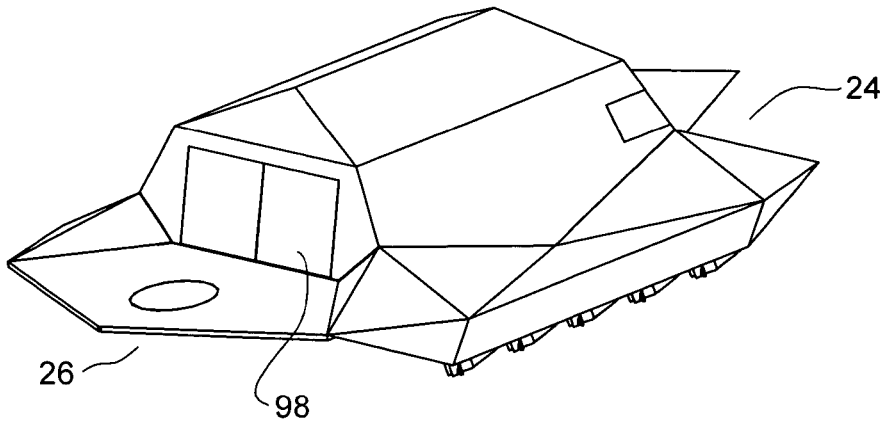
FIG. 15 is a perspective view of the embodiment depicted in FIG. 14.

FIG. 14 illustrates the trimaran shown in FIG. 12 configured with a helicopter pad 97 and hanger 98 in the stern 26. In this view, it is shown how easily the invention can be adapted for a variety of uses without changing the overall functionality of the hull design. Clearly, it would just as easy to modify this hull to carry automobiles which would be stored in the "hanger" 98.

Figure 16:
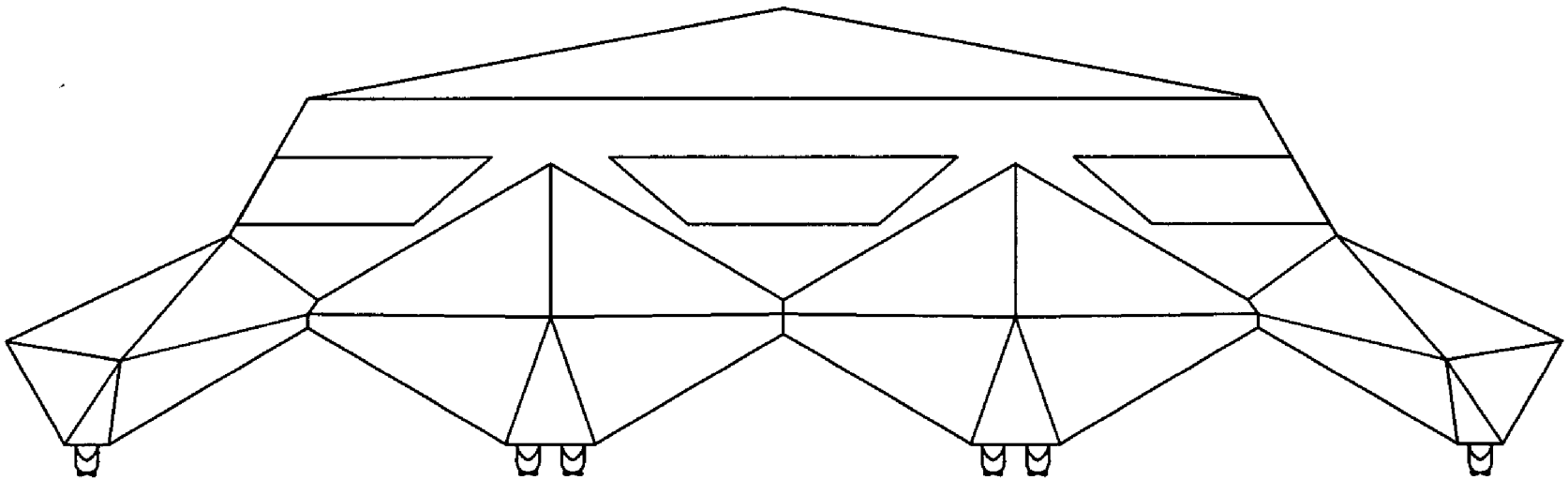
FIG. 16 is a bow view of the multi-hull apparatus configured with four hull sections.

FIG. 16 is a bow view of the multi-hull apparatus configured with four hull sections. Thus, it is possible to configure the invention with any number of hull sections ranging from the catamaran version on upward. Again, either single or multiple rows of propulsion units can be used on the inboard hull sections as was shown for the trimaran embodiment.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A multi-hull apparatus having an axis coincident with the direction of travel comprising, said apparatus comprising:

at least one starboard hull section having a bow section and a stern wave section; wherein said bow section and said stern section are substantially equal; and at least one port hull section having a bow section and a stern section; wherein said bow section and said stern section are also substantially equal; and wherein said at least one starboard hull section and said at one port hull section are also substantially equal thus making said apparatus bilaterally symmetrical as well as fore and aft symmetrical when viewed amidships; and each bow section and each stern section of said at least one starboard and port sections further comprising more than three triangular panels meeting a common point such that the common point of each said bow section and said each said stern section of each said hull sections are aligned to prove a hull section axis that is substantially parallel to the axis of the direction of travel; and wherein each said hull section has at least one sail and mast assembly to propel said multi-hull apparatus.

2. The apparatus of claim 1 further comprising a superstructure interconnecting section disposed between said at least one starboard and port hull sections.

3. The multi-hull apparatus of claim 1 having a centerline wherein said hull sections further comprises sufficient ballast below the centerline of said apparatus such that if said apparatus is turned bottom-side up, said apparatus will return to bottom-side down by itself.

4. A multi-hull apparatus having an axis coincident with the direction of travel comprising, said apparatus comprising:

at least one starboard hull section having a bow section and a stern wave section; wherein said bow section and said stern section are substantially equal; and at least one port hull section having a bow section and a stern section; wherein said bow section and said stern section are also substantially equal; and wherein said at least one starboard hull section and said at one port hull section are also substantially equal thus making said apparatus bilaterally symmetrical as well as fore and aft symmetrical when viewed amidships; and each bow section and each stern section of said at least one starboard and port sections further comprising more than three triangular panels meeting a common point such that the common point of each said bow section and said each said stern section of each said hull sections are aligned to prove a hull section axis that is substantially parallel to the axis of the direction of travel; and wherein each said hull section has at least one row of propulsion units; and wherein said at least one propulsion unit further comprises at least one hydropneumatic cylinder that can position said at least one propulsion unit at various angles of attack relative to the hull section axis that said at least one propulsion is attached thereto.

5. The apparatus in claim 4 wherein said at least one propulsion unit is an electric motor.

6. The apparatus in claim 4 wherein said at least one propulsion unit is powered by a diesel engine connected to at least one propeller.

7. The apparatus in claim 4 wherein said at least one propulsion unit is powered by a gasoline engine connected to at least one propeller.

8. The apparatus in claim 4 wherein said at least one propulsion unit is water jet impeller.

9. The apparatus of claim 4 further comprising a superstructure interconnecting section disposed between said at least one starboard and port hull sections.

10. The multi-hull apparatus of claim 9 having a centerline wherein said hull sections further comprises sufficient ballast below the centerline of said apparatus such that if said apparatus is turned bottom-side up, said apparatus will return to bottom-side down by itself.

* * * * *